US007934970B2

(12) United States Patent
O'Connor

(10) Patent No.: US 7,934,970 B2
(45) Date of Patent: May 3, 2011

(54) TRACK SET FOR TOY VEHICLES

(75) Inventor: Stacy Lynn O'Connor, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 436 days.

(21) Appl. No.: 12/111,169

(22) Filed: Apr. 28, 2008

(65) Prior Publication Data

US 2008/0265048 A1 Oct. 30, 2008

Related U.S. Application Data

(60) Provisional application No. 60/926,543, filed on Apr. 27, 2007.

(51) Int. Cl.
*A63H 17/02* (2006.01)
*A63B 71/00* (2006.01)

(52) U.S. Cl. ..... 446/6; 446/437; 446/444; 273/129 V; 273/127 A

(58) Field of Classification Search ..... 446/6, 437, 446/444–446, 429, 486; 273/129 V, 129 W, 273/129 S, 129 R, 127 R, 127 A, 108.1, 108.53
See application file for complete search history.

(56) References Cited

U.S. PATENT DOCUMENTS 4,513,967 A * 4/1985 Halford et al. ..... 273/108
4,605,229 A * 8/1986 McKay ..... 463/59
5,052,973 A * 10/1991 Rudell et al. ..... 446/429
5,234,216 A * 8/1993 Ostendorff ..... 273/127 A
5,254,030 A * 10/1993 Ostendorff et al. ..... 446/430
5,899,789 A * 5/1999 Rehkemper et al. ..... 446/444
6,435,929 B1 * 8/2002 Halford ..... 446/6

* cited by examiner

*Primary Examiner* — Kien T Nguyen
(74) *Attorney, Agent, or Firm* — Cantor Colburn LLP

(57) ABSTRACT

A track set for toy vehicles and a method for colliding toy vehicles are provided. The track set has a collision platform that defines a collision area. The track set further includes a first track member being pivotally secured to the collision platform at a pivot axis of the collision platform, and a second track member being pivotally secured to the collision platform at the pivot axis. The first and second track members each have a vehicle launcher for launching a toy vehicle towards the collision platform. The first track member defines a first vehicle pathway to the collision platform and the second track member defines a second vehicle pathway to the collision platform. The track set further includes an actuator configured to simultaneously activate the vehicle launcher of each of the first and second track members to propel at least one toy vehicle along at least one of the first and second vehicle pathways toward the collision area.

20 Claims, 6 Drawing Sheets

TRACK SET FOR TOY VEHICLES

CROSS REFERENCE TO RELATED APPLICATION

The application claims the benefit of U.S. Provisional application Ser. No. 60/926,543, filed Apr. 27, 2007, the contents of which are incorporated herein by reference thereto.

BACKGROUND

Toy vehicle track sets have been popular for many years and generally include one or more track sections arranged to form a path around which one or more toy vehicles can travel. Toy vehicles which may be used on such track sets may be either self-powered vehicles or may receive power from an external source.

A toy vehicle track set may provide a single vehicle pathway such that the vehicle runs the track encountering the same track features lap after lap. Additional vehicles may be placed on the track, but the additional vehicles generally follow the same vehicle pathway. The repetitive nature of vehicle travel may result in loss of interest in the track set over a short period of time.

The inventors herein have recognized that additional interactive features, such as features which allow play with more than one vehicle simultaneously on different vehicle paths may increase the play value of the track set.

SUMMARY OF THE INVENTION

A track set for toy vehicles in accordance with an exemplary embodiment is provided. The track set has a collision platform that defines a collision area. The track set further includes a first track member being pivotally secured to the collision platform at a pivot axis of the collision platform, and a second track member being pivotally secured to the collision platform at the pivot axis. The first and second track members each have a vehicle launcher for launching a toy vehicle towards the collision platform. The first track member defines a first vehicle pathway to the collision platform and the second track member defines a second vehicle pathway to the collision platform. The track set further includes an actuator configured to simultaneously activate the vehicle launcher of each of the first and second track members to propel at least one toy vehicle along at least one of the first and second vehicle pathways toward the collision area.

A method for colliding toy vehicles on a track set in accordance with another exemplary embodiment is provided. The method includes loading a first toy vehicle in a first vehicle launcher, configured for launching the first toy vehicle along a first track member having an end pivotally secured at a pivot axis of a collision platform having a collision area. The method further includes loading a second toy vehicle in a second vehicle launcher, configured for launching the second toy vehicle along a second track member having an end pivotally secured to the pivot axis of the collision platform. The method further includes actuating the first vehicle launcher and the second vehicle launcher to simultaneously propel the first toy vehicle and the second toy vehicle towards each other in the collision area.

DETAILED DESCRIPTION OF EXEMPLARY EMBODIMENTS

A track set having at least two track members selectively positionable to define corresponding vehicle pathways is provided. An example embodiment includes a single actuator that may be configured to simultaneously release vehicles disposed in launch positions in the track members. Release of the vehicles may result in the vehicles traveling along their respective vehicle pathways to a collision platform.

Figure 1:
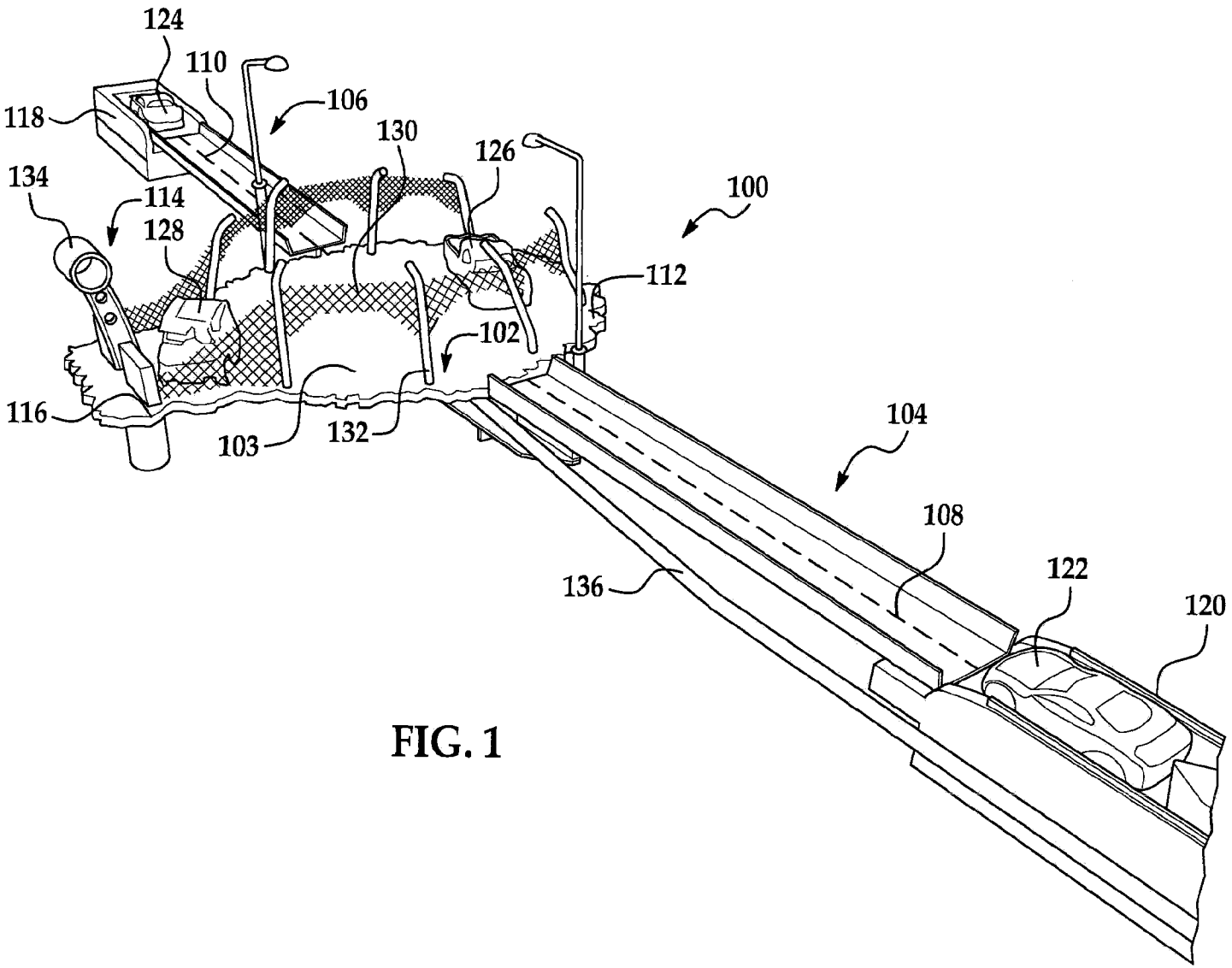
FIG. 1 is a schematic of a toy vehicle track set including a collision platform in accordance with an exemplary embodiment.

Referring now to FIG. 1, an example track set 100 is illustrated. Track set 100 includes a collision platform 102 and track members 104, 106. Although illustrated with two track members, it should be appreciated that the track set may include any number of track members, for example, the track set may have one, two, three, or four or more track members.

Track members 104, 106 may be selectively positioned such that a user may provide different configurations for the track set. The track members 104, 106 have extension portions 147, 148, respectively, that are rotatably coupled to a post 149 extending from a bottom portion of the collision platform 102. Accordingly, the track members 104, 106 can be rotated about a longitudinal axis of the post 149 relative to one another to provide different track member configurations. Track members 104, 106 define vehicle paths 108, 110 respectfully. In the illustrated embodiments, the track members are positioned such that the vehicle paths intersect at collision platform 102. Vehicles launched from track members 104, 106 are configured to collide or crash in collision platform 102. Further, although track members 104, 106 are shown as defining straight line vehicle paths 108, 110, track members may be of any suitable configuration and may optionally include additional track features, including curves, stunts, jumps, loops, etc. Further, although track members 104, 106 are shown as being similarly sized in regards to the length of the track and the vehicle path, it should be appreciated that the track members may be of different sizes, such that one track member may be longer or shorter and define a longer or shorter path compared to another track member.

Collision platform or stage 102 has a collision area 103 where two or more toy vehicles are configured to collide or impact. In some embodiments, collision platform 102 may further include additional impact features into which the toy vehicles may be configured to collide. For example, the collision platform may include impact features or obstacles, such as garbage, flags, cones, simulated barriers or walls, etc. into which the vehicles may collide. Further additional toy vehicles may be positioned in the collision platform such that the vehicles traveling from track members 104, 106 further collide with the vehicles pre-positioned in the collision platform. Although described in regards to a collision platform, the collision platform may be any zone into which the track members direct the vehicles.

Collision platform 102 may be a raised platform, although other configurations are possible, including collision platforms which may be disposed directly on a ground surface. In the illustrated embodiment, collision platform 102 may have drop off edges 112 such that the vehicles may tumble or fall from the collision platform, such as to the ground surface. The impact from the vehicle collision may be such that one or more vehicles may spin off and fall from the collision platform, increasing excitement regarding the crash and enhancing the playability with the track set.

Further, it is noted that collision platform 102 may be a substantially circular platform. The shape of the collision platform may enable vehicles to spin off in any direction and fall off of the collision platform. Although shown as a substantially circular platform, it should be appreciated that the collision platform may be any other shape, including, but not limited to, squares, ovals, triangular, trapezoidal, hexagonal, etc.

An actuator 114 may be provided for track set 100. Actuator or trigger 114 may be operatively linked to track members 104, 106 such that the actuator may be used to release a vehicle disposed in the launch position on track members 104, 106. In the illustrated embodiment, actuator 114 is shown disposed on an extended portion 116 of collision platform 102, however, actuator 114 may be otherwise positioned. For example, actuator 114 may be a separate device or a removable/detachable device such that it may be handheld or operated without touching of the collision platform. Further, although actuator 114 is shown simulating a vehicle throttle or gear shift, actuator may be of any desired configuration.

Actuator 114 may be configured to simultaneously release vehicles disposed in vehicle launchers 118 and 120. Although shown in regards to automatically releasing vehicles from two vehicle launchers, it should be appreciated that the actuator may be configured to release vehicles from any number of launchers. Assuming vehicles 122 and 124 are disposed in vehicle launchers 120 and 118 respectfully, actuation of actuator 114 results in vehicles 122 and 124 being released and launched along vehicle paths 108 and 110. The vehicles 122, 124 travel along the respective vehicle path into collision platform 102. The vehicles may impact. One or both of the vehicles, upon impact, may spin out, flip over, fly, roll, etc. in collision platform 102 and/or fall off of collision platform 102. Additional vehicles, such as vehicles 126, 128 which are also in collision platform 102 may also be impacted as a result of the release of vehicles 122 and 124 creating additional impact chaos. Although a single actuator is shown, in some embodiments, multiple actuators may be provided. Moreover, although described in regards to a single actuator configured to simultaneously release multiple launchers, in some embodiments, the actuator may be configured to release multiple launchers at different times, such as through a delay switch, or the actuator may enable selection of one or more launchers such that a user can choose which launchers are activated through use of the actuator.

It is noted that in some embodiments, such as the embodiment illustrated in FIG. 1, boundary features, including retention member 130 and posts 132, may be provided to define the collision platform 102. Boundary features may further enhance the collision effect as vehicles may bounce off of the boundary features back into the collision platform.

In the illustrated embodiment, actuator 114 may include a hand release 134 which may be operatively linked through a linkage rod 136 to one or more launchers. Details regarding an example actuator and launcher are described in more detail in regards to FIGS. 4-6.

Users may find increased play value with the disclosed track set. For example, users may compete to keep their vehicles in the collision platform. One objective in such play may be to knock or push a competitor's vehicle (or obstacle or other vehicle) out of the collision platform. A single user may further find enhanced play value by attempting to have certain vehicles remain in the collision platform while knocking other vehicles or obstacles out of the collision platform. The player or vehicle which remains in the collision platform may be considered the winning vehicle. Further, in other embodiments, users may position the track members such that the vehicles travel side-by-side upon release from their respective launchers. Racing games and speed games may be played in such a configuration.

Figure 2:
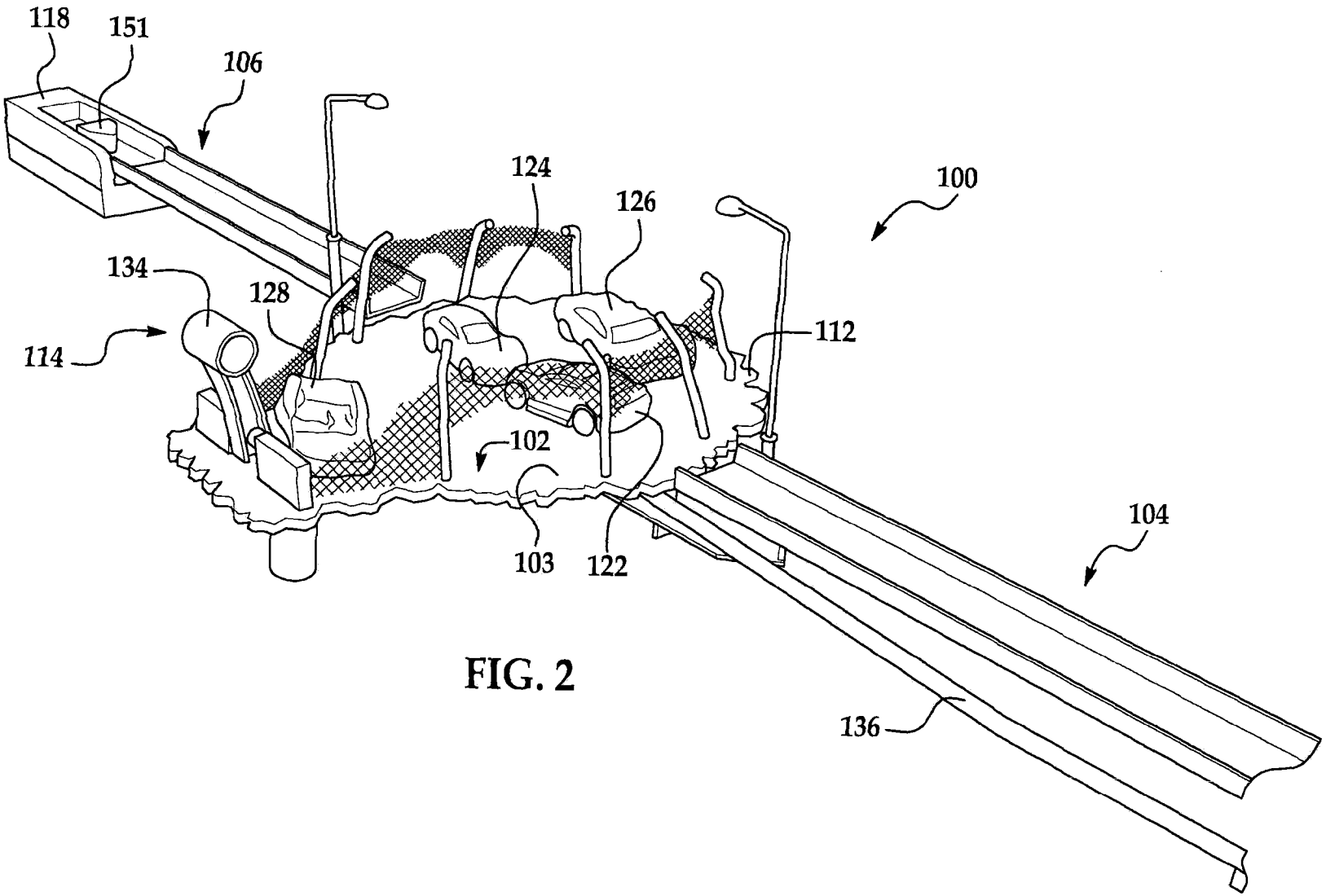
FIG. 2 is a schematic of the toy vehicle track set of FIG. 1.
Figure 3:
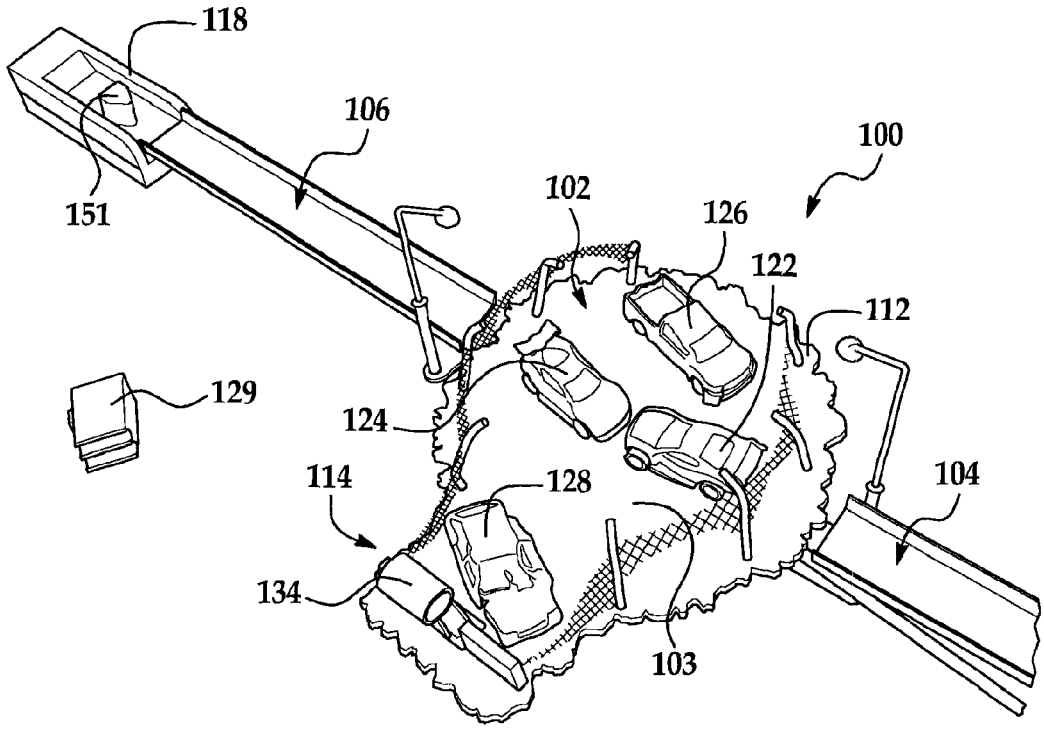
FIG. 3 is an exploded view of the collision platform of the track set of FIG. 1.

FIGS. 2 and 3 further illustrate the track set of FIG. 1. In FIGS. 2 and 3, vehicles 122 and 124 have been released from launchers 120 and 118 (not shown in FIG. 2), such that the vehicles traveled along track members 104 and 106 and are on a course to collide on collision platform 102. Upon collision, one or both toy vehicles 122, 124 may spin out, flip over, fly, roll, etc. Further the collision of the toy vehicles may result in an impact against one or more of the other vehicles 126, 128 in collision platform 102, such that the other vehicles may spin out, flip over, fly, roll, etc. Further, any one of the vehicles may fall of collision platform 102 or be rebounded back into collision platform 102 through the boundary features.

As a further example and as described above, collision platform 102 may include impact features or obstacles, such as garbage obstacle 129. Players may position obstacles in the collision platform and position the track members such that the vehicles are aimed at the obstacles. Users may find increased play value in releasing the vehicles from the launcher into the collision platform to knock obstacles from the collision platform. Obstacle 129 is provided as an example of a successful obstacle collision where the obstacle has popped off of the collision platform. Similarly, increased play value may be provided by colliding with the other toy vehicles positioned in the collision platform such that they too are flipped or knocked out of the collision platform, similar to obstacle 129.

Figure 4:
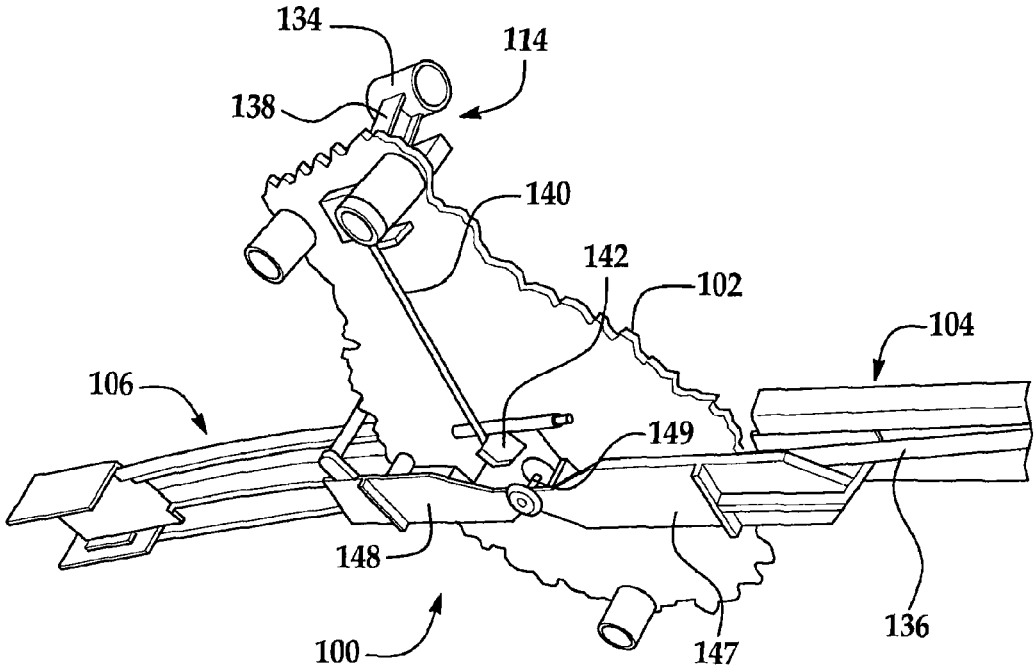
FIG. 4 is a schematic of an underside of the collision platform of the track set of FIG. 1.

FIG. 4 shows the underside of an example collision platform 102 of track set 100. As described above, track set 102 may include one or more track members 104 and 106 which may be selectively positioned relative to collision platform 102. An actuator 114 may be operatively linked to launchers disposed on each track member such that actuation of actuator 114 results in simultaneous release of the launchers to propel vehicles along the respective track members. As an example, actuator 114 may include a hand release or handle 134. The actuator may be pivoted, such as in a downwards or upwards orientation, such that a linkage 140, operatively linked to an activator 142 and one or more rod linkages 136, results in triggering of the launcher, such as launcher 120.

Figures 5, 6:
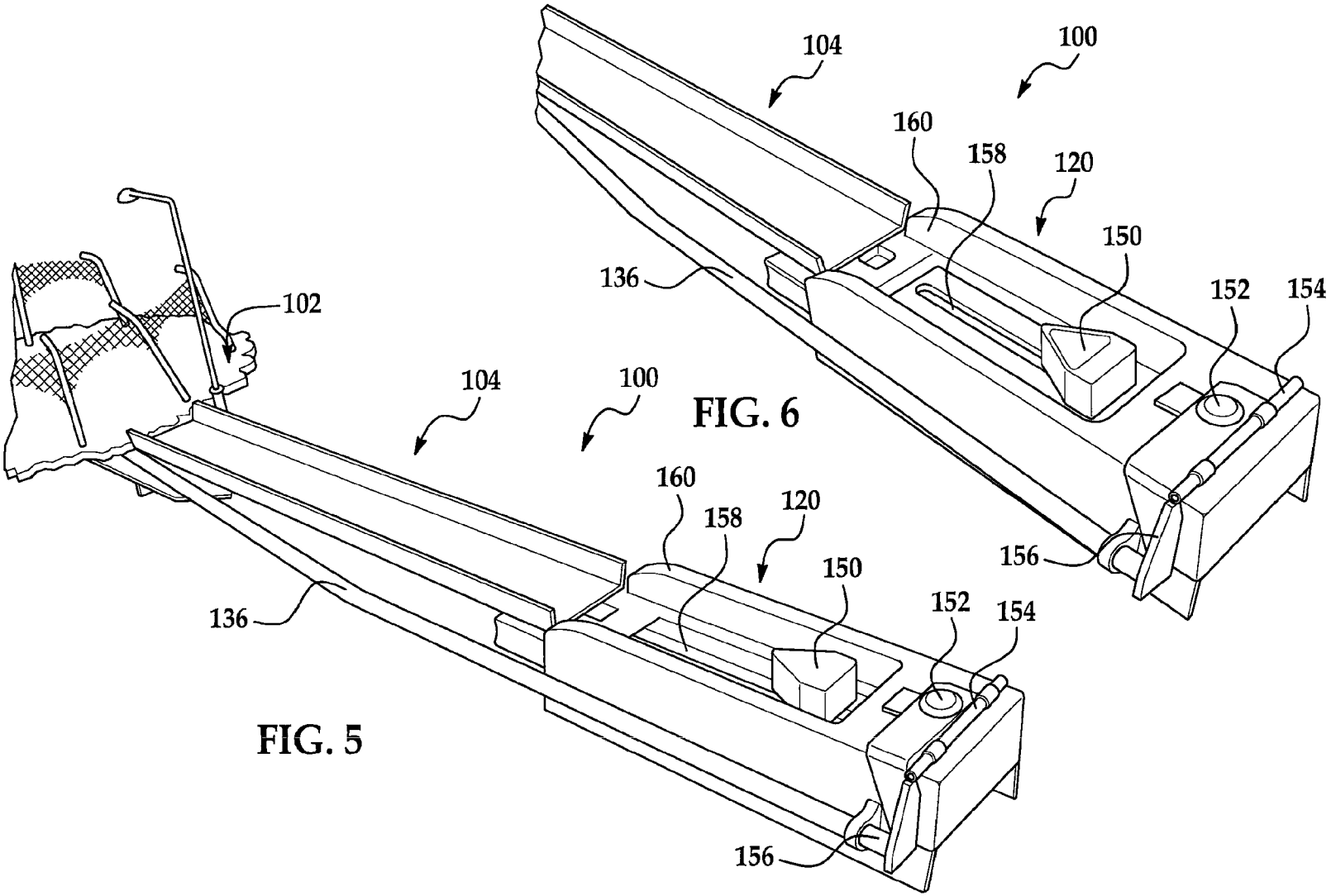
FIG. 5 is a schematic of a track member having a first vehicle launcher of the track set of FIG. 1.
FIG. 6 is a schematic of the vehicle launcher of FIG. 5.

FIGS. 5 and 6 illustrate launcher 120 in more detail. It should be noted that launch 118 has a substantially similar structure as launcher 120. As illustrated launcher 120 may be disposed on the outer end of track member 104. Launcher 120 is configured to receive a toy vehicle in a launch position. As an example, a spring-loaded launch member 150 may abut or be positioned to contact the toy vehicle when it is positioned in the launch position such that release of the launch member, such that it travels along slide aperture 158 results in the vehicle being propelled from the launcher along track member 104. In some embodiments, a user may be able to selectively release launch member 150. For example a release switch or button 152 may be provided such that a user may selectively release launch member 150 to propel a vehicle along track member 104. In particular, the launch member 150 may be operably coupled to a rubber band and to a latching member such that actuation of the release switch 152 causes the latching member to move and allows the rubber band under tension to propel the launch member 150 in a first direction. A stop 160 may be provided in slide aperture 158 such that the launch member may be stopped and reloaded for a second vehicle launch.

Further, as described above, an actuator 114 (not shown in FIGS. 5 and 6) may be operatively coupled to the launchers 118 and 120, and more specifically to the launch members 151 and 150, respectively, such that activation of the actuator results in the launch members 151 and 150 being simultaneously released. As an example, actuator 114 may be linked to rod linkage 136 which may engage against a coupler 156. Actuation of actuator 114 may result in rod linkage 136 triggering coupler 156 to activate respective switches 152 on the launchers 118 and 120. It is noted that coupler 156 may be rotatably connected, such as through structure 154, however other linkages, and activator systems, may be used without departing from the scope of the disclosure.

Figure 9:
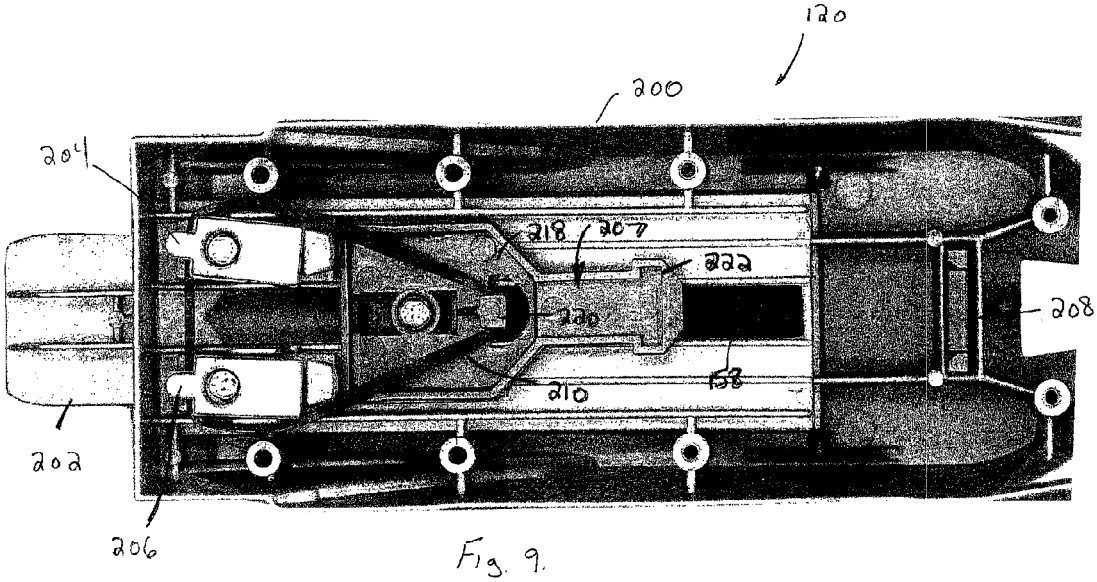
FIG. 9 is a schematic of a bottom portion of the vehicle launcher of FIG. 5.
Figure 10:
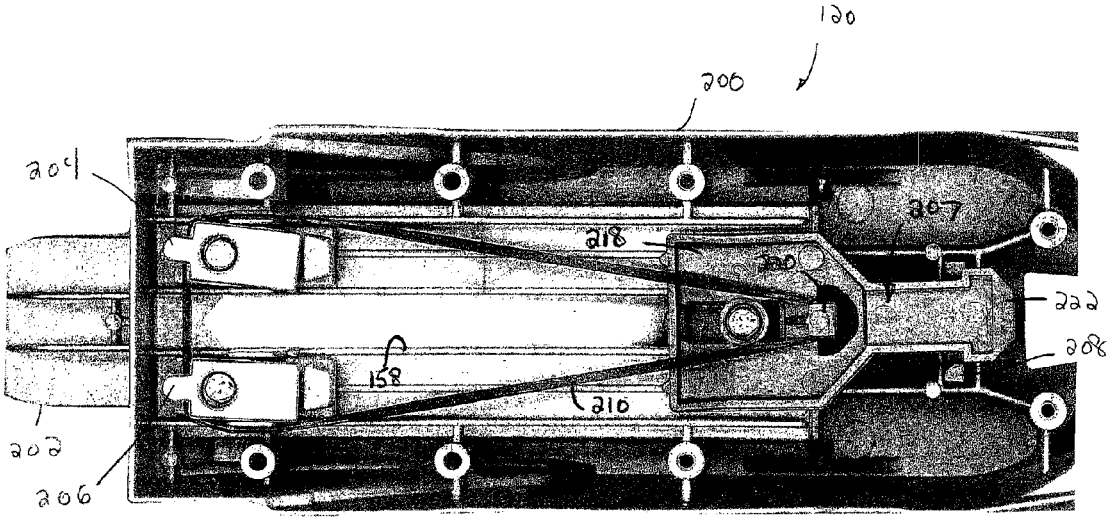
FIG. 10 is another schematic of a bottom portion of the vehicle launcher of FIG. 5.

Further, FIGS. 9 and 10 illustrate a bottom view of an exemplary launcher 120 utilized in the track set 100. It should be noted that launcher 118 has a substantially similar configuration as launcher 120. As shown, launcher 120 further includes a housing 200, a tab portion 202, securement members 204, 206, a slider member 207, a latching member 208, and a rubber band 210. Tab portion 202 extends from a first end of housing 200 and is configured to attached to an end of track member 104. Securement members 204, 206 are fixedly attached to housing 200 proximate to the first end of housing 200. Slider member 207 is configured to slide within the slide aperture 158 to launch the vehicle 122. Slider member 207 is attached to launch member 150 which is disposed on the opposite side of housing 200. Slider member 207 has a body portion 218, a securement tab 220 and an engagement portion 222. Securement tab 220 is fixedly attached to body portion 218. The rubber band 210 is stretched around securement members 204, 206 and securement tab 220 on slider member 207. FIG. 9 illustrates the rubber band 210 in an unbiased state such as after the vehicle 122 has been launched. Latching member 208 moves through an aperture in housing 200 and has a latched operational position and an unlatched operational position. As shown in FIG. 10, when the slider member 207 and the launch member 150 are moved toward the latching member 208 such that the latching member 208 engages engagement portion 22 of slider member 207, latching member 208 latches the slider member 208 to maintain rubber band 210 in a biased state. Thereafter, when either actuator 114 or activate switch 152 moves latching member 208 upwardly to an unlatched operational position, latching member 208 unlatches engagement portion 222 and rubber band 210 urges slider member 207 and launch member 150 toward the first end of housing 200 to launch vehicle 122 down track member 104. Exemplary embodiments of the present invention are not intended to be limited to the specific launchers described above. For example, other releasable spring biased Launchers for launching toy vehicles are well known to those skilled in the art. For example, exemplary launchers for toy vehicles are described in U.S. Pat. No. 4,108,437 entitled "Toy Vehicle Starting and Launching Set", issued on Aug. 22, 1978 and U.S. Pat. No. 6,435,929 and U.S. Patent Publication No. 2007/0293122 entitled "Track Set", filed on May 4, 2007.

Figure 7:
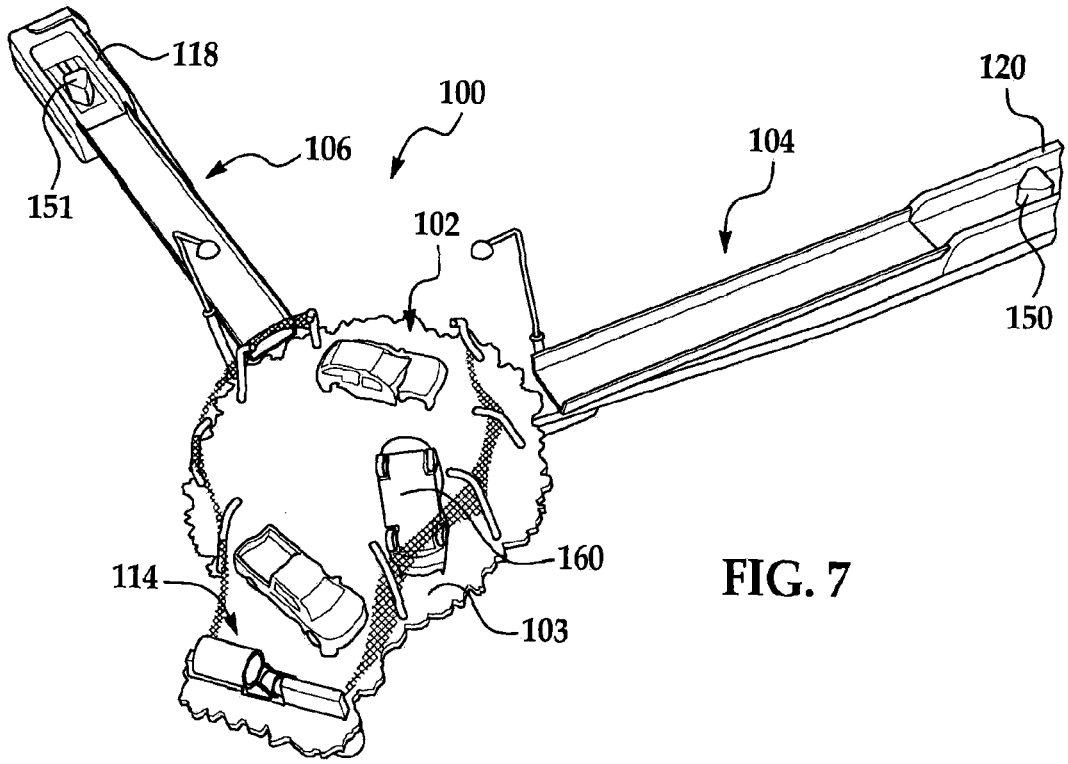
FIG. 7 is a schematic of the toy vehicle track set of FIG. 1 in a second exemplary configuration.
Figure 8:
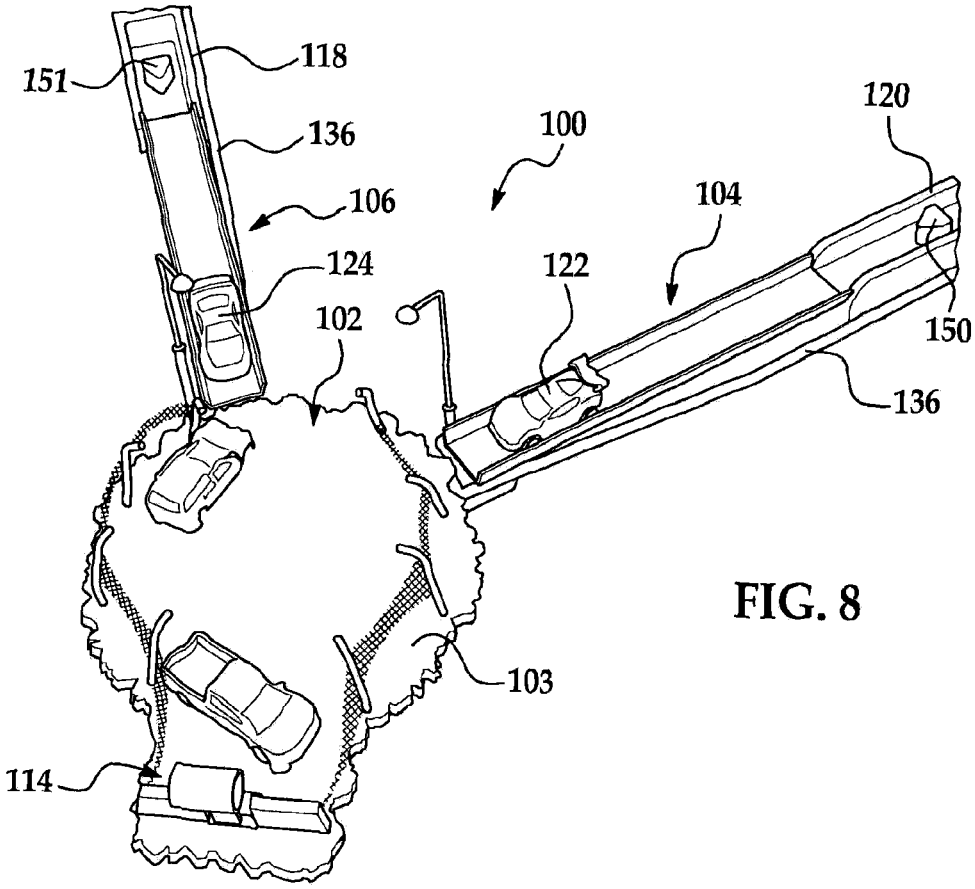
FIG. 8 is a schematic of the toy vehicle track set of FIG. 1 in a second exemplary configuration.

FIGS. 7 and 8 further illustrate toy vehicle track 100 in a second exemplary configuration. Specifically, as described above, track members 104, 106 may be configured to be selectively positioned along the edge of collision platform 102. For example, a user may position track members 104 and 106 such that vehicles traveling along the vehicle paths defined by the track members engage in a head on collision (such as the configuration shown in FIG. 1). Alternatively, a user may position track members 104 and 106 such that vehicles traveling along the track members have at least a partial side impact or collision. As such, FIGS. 7 and 8 illustrate a second configuration where track members 104 and 106 are positioned at approximately a 90 degree angle from each other. It should be appreciated that the track members may be positioned in other orientations, including, but not limited to angles as low as 5 degrees where the track members are as close as possible to each other to as high as 355 degrees. In some embodiments, the track members may be positioned 15-270 degrees from each other. As another example, and as briefly mentioned above, the track members may be positioned such that the track members enable the respective vehicle paths to be substantially parallel to each other. In such a configuration, a user may engage in side-by-side racing of toy vehicles.

In the second exemplary configuration, a user may position, vehicles 124 and 122 in launchers 118 and 120 respectively. The launch members may be in a loaded position, such that release of the launch member propels a vehicle to the collision platform. For example, a user may load, only one launcher, such as launcher 118 in FIG. 7. Loading the launcher may include manually retracting the launch member 150 such that it is in a loaded or prerelease position (as shown at 150 in FIG. 7). The user may then actuate the launcher 118 by actuator 114, which upon actuation (through a corresponding linkage system, including rod linkage 136), may effect release of launch member 151 (which is shown in a launcher position) such that the vehicle 124 is propelled down track member 106 to collision platform 102. As an alternative, a user may be able to manually release launch member 151 or manually propel the vehicle down track member 106. FIG. 8 further illustrates a second vehicle 122 being propelled simultaneously along track member 104 to crash pad 102. As described above, actuator 114 may be configured to release the launch members of both launchers 118 and 120 simultaneously.

The above described actuator, launcher, launch members and linkage systems are provided as non-limiting examples. It is to be understood that any actuator, launcher, launch members and linkage systems that can be used to activate one or more launchers for propelling a collision vehicle into a collision platform can be used without departing from the scope of this disclosure.

While the present invention has been described in terms of specific embodiments, it should be appreciated that the spirit and scope of the invention is not limited to those embodiments. The features, functions, elements and/or properties, and/or combination and combinations of features, functions, elements and/or properties of the track set may be claimed in this or a related application. All subject matter which comes within the meaning and range of equivalency of the claims is to be embraced within the scope of such claims.

What is claimed is:

1. A track set for toy vehicles, comprising:

a collision platform defining a collision area;

a first track member being pivotally secured to the collision platform at a pivot axis of the collision platform, and a second track member being pivotally secured to the collision platform at the pivot axis, the first and second track members each having a vehicle launcher for launching a toy vehicle towards the collision platform, the first track member defining a first vehicle pathway to the collision platform and the second track member defining a second vehicle pathway to the collision platform; and an actuator configured to simultaneously activate the vehicle launcher of each of the first and second track members to propel at least one toy vehicle along at least one of the first and second vehicle pathways toward the collision area.

2. The track set of claim 1, further comprising at least first and second posts extending from the collision platform and a retention member disposed between the first and second posts.

3. The track set of claim 2, wherein the first and second posts are disposed proximate to an outer periphery of the collision platform.

4. The track set of claim 1, wherein the first and second vehicle pathways intersect one another such that the toy vehicles impact one another in the collision area.

5. The track set of claim 1, wherein the actuator is operatively coupled to each vehicle launcher through a linkage system.

6. The track set of claim 1, wherein each vehicle launcher has a spring loaded member that when actuated urges each toy vehicle toward the collision platform.

7. The track set of claim 1, wherein the first and second track members are capable of being disposed to the collision platform substantially opposite to one another.

8. The track set as in claim 1, wherein the post extends from a bottom of the collision platform.

9. A method for colliding toy vehicles on a track set, the method comprising:

loading a first toy vehicle in a first vehicle launcher, configured for launching the first toy vehicle along a first track member having an end pivotally secured at a pivot axis of a collision platform having a collision area;

loading a second toy vehicle in a second vehicle launcher, configured for launching the second toy vehicle along a second track member having an end pivotally secured to the pivot axis of the collision platform; and actuating the first vehicle launcher and the second vehicle launcher to simultaneously propel the first toy vehicle and the second toy vehicle towards each other in the collision area.

10. The method of claim 9, further comprising rotating any one of the first track and the second track to vary the angular position of the first track and/or the second track with respect to the collision area.

11. The method of claim 9, further comprising disposing an object on the vehicle platform such that the first toy vehicle and/or the second toy vehicle collides with the object in the collision area.

12. The method of claim 9, further comprising disposing an object on the vehicle platform such that the first toy vehicle and/or the second toy vehicle collides with the object in the collision area.

13. A track set for toy vehicles, comprising:

a collision platform defining a collision area;

a first track member being pivotally secured to a post of the collision platform such that the first track member can rotate about a pivot axis of the post;

a second track member also pivotally secured to the post of the collision platform such that the second track member can also rotate about the pivot axis of the post;

a first vehicle launcher for launching a toy vehicle along the first track member and towards the collision platform;

a second vehicle launcher for launching another toy vehicle along the second track member and towards the collision platform; and an actuator configured to simultaneously activate the first vehicle launcher and the second vehicle launcher.

14. The track set as in claim 13, wherein the first track member is pivotally secured to the post by a first extension portion and the second track member is pivotally secured to the post by a second extension portion each of which are rotatably coupled to the post.

15. The track set as in claim 14, wherein the post extends from a bottom of the collision platform.

16. The track set as in claim 15, wherein the first extension portion and the second extension portion each have a distal end that extends away from a peripheral edge of the collision platform wherein the distal end is secured to a respective one of the first track member and the second track member.

17. The track set as in claim 16, wherein the first track member and the second track member do not extend below the collision platform.

18. The track set as in claim 13, wherein the first vehicle launcher is located at an end of the first track member such that the first track member is disposed between the first vehicle launcher and the collision platform and the second vehicle launcher is located at an end of the second track member such that second track member is disposed between the second vehicle launcher and the collision platform and wherein the actuator is coupled to the first vehicle launcher and the second vehicle launcher via linkage members.

19. The track set as in claim 18, wherein the actuator further comprises a handle mounted to the collision platform.

20. The track set as in claim 18, wherein the first track member is pivotally secured to the post by a first extension portion and the second track member is pivotally secured to the post by a second extension portion each of which are rotatably coupled to the post and wherein the post extends from a bottom of the collision platform.

* * * * *